US005127335A

United States Patent [19]

Whitaker, Jr.

[11] Patent Number: 5,127,335

[45] Date of Patent: Jul. 7, 1992

[54] POINTS AND CROSSING CHANGER

[75] Inventor: John B. Whitaker, Jr., Wetumpka, Ala.

[73] Assignee: Kershaw Manufacturing Company, Inc., Montgomery, Ala.

[21] Appl. No.: 550,065

[22] Filed: Jul. 9, 1990

[51] Int. Cl.[5] ..... E01B 29/02

[52] U.S. Cl. ..... 104/3; 104/7.1

[58] Field of Search ..... 104/7.1, 7.2, 3, 5, 104/2

[56] References Cited

U.S. PATENT DOCUMENTS

| | | | |
|---|---|---|---|
| 4,249,467 | 2/1981 | Theurer et al. | 104/3 |
| 4,270,456 | 6/1981 | Theurer et al. | 104/3 |
| 4,566,389 | 1/1986 | Theurer et al. | 104/3 |
| 4,773,332 | 9/1988 | Theurer et al. | 104/3 |
| 4,827,848 | 5/1988 | Kusel | 104/3 |

OTHER PUBLICATIONS

Gomaco Corporation, GP-3500 4-Track, 1989, 2 pages, Copyright 1989 GOMACO Corporation SB503X96H.

*Primary Examiner*—Douglas C. Butler
*Assistant Examiner*—Kevin D. Rutherford
*Attorney, Agent, or Firm*—Jennings, Carter, Thompson & Veal

[57] ABSTRACT

A points and crossing changer including an elongated frame having a plurality of extendible support members pivotally mounted thereon for horizontal movement about a vertical axis. Each support member includes a downwardly extendible telescoping shaft supported on a lower end by a tracked conveyor pivotally mounted thereon. Mounted to the frame is means for engaging selected sections of track subjacent frame wherein the frame and the selected section of track can be lifted by the telescopic shafts and propelled in an unlimited variety of horizontal directions by the tracked conveyors.

15 Claims, 5 Drawing Sheets

POINTS AND CROSSING CHANGER

FIELD OF THE INVENTION

The present invention relates to railroad equipment and more particularly to an apparatus for repairing railroad track. In greater particularity, the present invention relates to an apparatus for removing and replacing preassembled sections of track including points and crossings.

BACKGROUND OF THE INVENTION

The primary purpose of railroad repair machinery is to reduce the man hours typically required to assemble and repair railroad track. Apparatus specifically designed to remove and replace used or unwanted track with new preassembled sections of track is not unknown. However, the prior art discussed herein still contains certain disadvantages that my apparatus has remedied.

U.S. Pat. No. 4,270,456 issued to Theurer utilizes a first transport vehicle designed for exclusive travel on existing railroad track, having an elongated girder with an elongated carrier arm pivotally mounted on each end thereof. The girder is supported in spaced relation above the first transport vehicle by four C-shaped gantries which are pivotally connected to the transport vehicle and the elongated girder. A trolley system is connected beneath the girder and arms and conveys track from a second transport vehicle to beyond the forward end of the first transport vehicle. The gantries are bowed to permit wide sections of preassembled track such as points and crossings to be moved along the guides.

U.S. Pat. No. 4,827,848 issued to Kusel teaches of a method for replacing a preassembled track section utilizing gantries and temporary track. The process of laying the temporary track and setting the fixed gantries is very time consuming requiring the temporary track to be winched back and forth from its transport vehicle.

U.S. Pat. No. 4,773,332 issued to Theurer et al discloses an apparatus for replacing elongated track sections. The invention includes a lower transport vehicle for carrying the track sections and at least one gantry carriage for raising and lowering various track sections. The lower transport has a plurality of flanged wheels for travel on existing track sections and a set of tracked conveyors for travel along a horizontal grade. Though pivotally mounted, the tracked conveyors are centrally located beneath the transport and operate from vertical axis located along the longitudinal axis of the transport. The gantry carriages rest atop and are secured to the track to be lifted and have laterally and vertically distendable jacks that lift such track.

U.S. Pat. No. 4,249,467 issued to Theurer et al discloses two carriage sections slidably connected to an elongated girder which is supported intermediate the two carriages and has a hoist mounted thereunder. The carriages are primarily supported on flanged wheels for engagement with a track but have alternate tracked conveyors as well for horizontal movement over grade. The tracked conveyors are mounted beneath the carriage and not only support the bulky carriages but also the expansive guide system mounted therebetween.

The Gomaco GP-3500 4-TRACK is used for laying and smoothing road pavement has tracked conveyors that pivot 15 degrees from a forward longitudinal axis; however, this pivotal movement was only contemplated for minute adjustments in forward direction. The legs on the Gomaco paver can be adjusted upward no more than one foot and such adjustment is not contemplated to facilitate the lifting of objects suspended thereunder or the induction thereunder of transport means..

SUMMARY OF THE INVENTION

It is the principal object of the present invention to provide apparatus for mechanically replacing old sections of railroad track with new preassembled sections of track.

In support of the principal object, another object of the invention is to provide track replacing apparatus that can move in an unlimited range of horizontal directions unattached to and unaffected by the location of existing railroad track.

Yet another object of the present invention is to provide track replacing apparatus with a low center of gravity.

Still another object of the invention is to provide track replacing apparatus that is agile enough to safely negotiate the inclines typical of a railroad work area.

A further object of the invention is to provide track replacing apparatus that incorporates all the aforementioned objects and works in conjunction with one or more common flat cars which transport the replacement tracks from a central storage point, thereby eliminating the need to continually stop the replacement operations so the track replacing apparatus can be restocked with track.

These and other objects and advantages of my invention are accomplished through the use of an elongated frame including a pair of elongated box frames joined at adjacent ends for pivotal movement about a vertical axis and a pair of slides, each slidably mounted longitudinally within one of the elongated box frames. A plurality of extendible support members are each pivotally mounted to the frame for horizontal movement about a vertical axis and include a telescopic shaft for lifting the frame. Supporting each shaft is a tracked conveyor mounted thereunder for rotary movement around a vertical axis. Each tracked conveyor is driven by a separate motor and can be remotely operated separately or in unison with the other tracked conveyors. Extendible clamps are mounted subjacent to the box frames and the sliders for engaging sections of track of varying gauges and orientation beneath the frame.

BRIEF DESCRIPTION OF THE DRAWINGS

Apparatus embodying features of my invention are depicted in the accompanying drawings which form a portion of this disclosure and wherein.

DESCRIPTION OF THE PREFERRED EMBODIMENT

Figure 1:
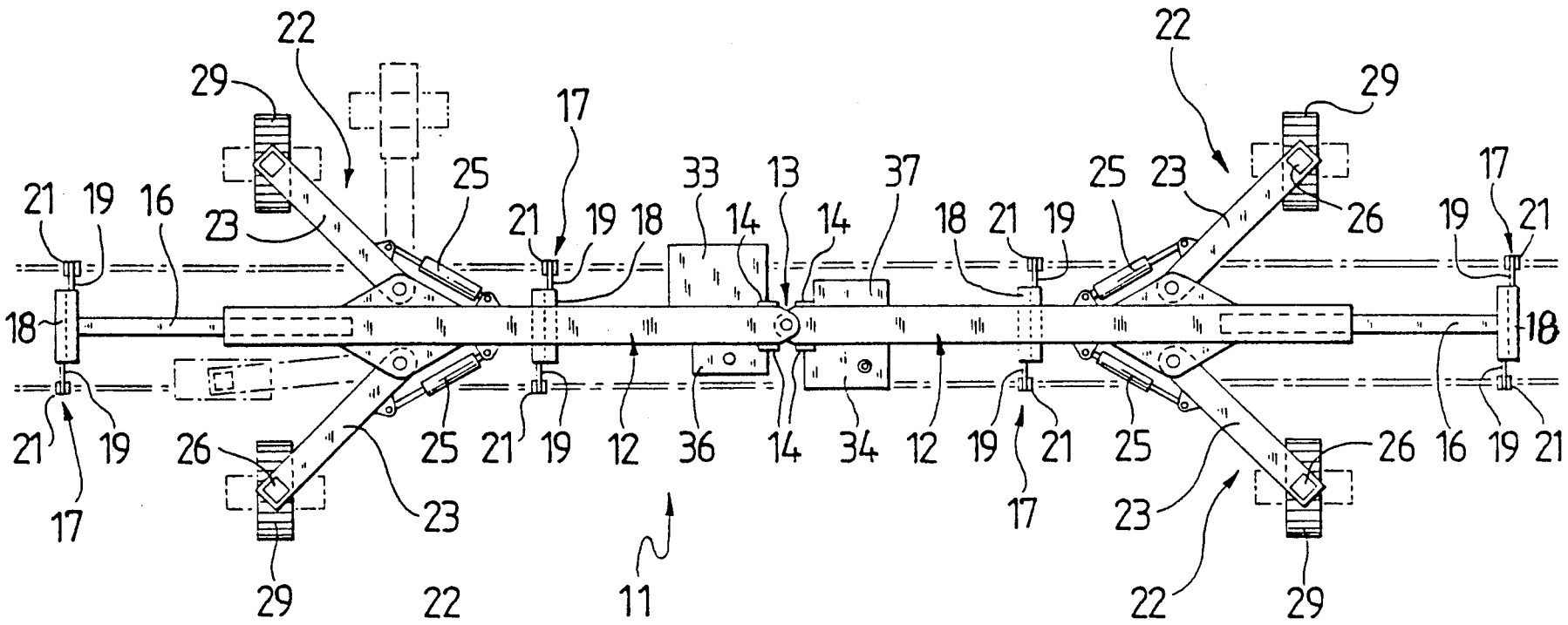
FIG. 1 is a top plan view of the present invention.
Figure 2:
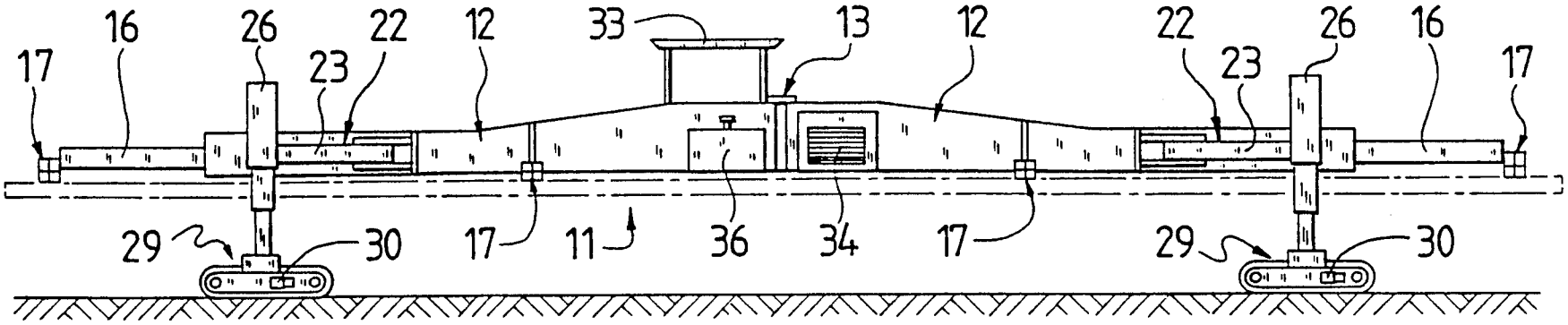
FIG. 2 is a side elevational view of the present invention with legs extended.

Referring to the drawings for a clearer understanding of the present invention, it should be noted in FIGS. 1 and 2 that the present invention contemplates the use of an joined at adjacent ends by a clevis and pin 13 for pivotal movement about a vertical axis. The box frames 12 only pivot fifteen degrees from the longitudinal axis of the frame 11 and are prevented from further deflection by stops 14 mounted thereon. Each box frame 12 is cross-sectionally rectangular having a hollow interior in which wires, conduits, and other control apparatus (not shown) are isolated from the environment, inadvertent damage by workers or vandalism. The frame 11 also includes a pair of sliders 16, each slidably mounted longitudinally within one of the elongated box frames 12 for extension and retraction relative to an outer end thereof. Mounted on the extendible end of each slider 16 and also subjacent the box frames 12 at selective points are a plurality of adjustable clamp assemblies 17 which serve as a means for securing and supporting a section of track beneath the box frames 12 and/or the sliders 16. Each clamp assembly 17 includes a central casing 18 mounted to either the box frames 12 or extenders 16 and laterally extending in both directions therefrom. Each casing 18 has a pair of clamp beams !9 slidably mounted therein for opposing lateral extension and retraction therefrom. Each clamp assembly 17 also includes a pair of rail clamps 21, each mounted to and suspended beneath the distendable end of one of the clamp beams 19. The rail clamps 21 selectively engage and support a section of track subjacent the frame 11 being laterally adjustable by the distention and retraction of the clamp beams 19 to accommodate a variety of track gauges and orientations.

Figure 3:
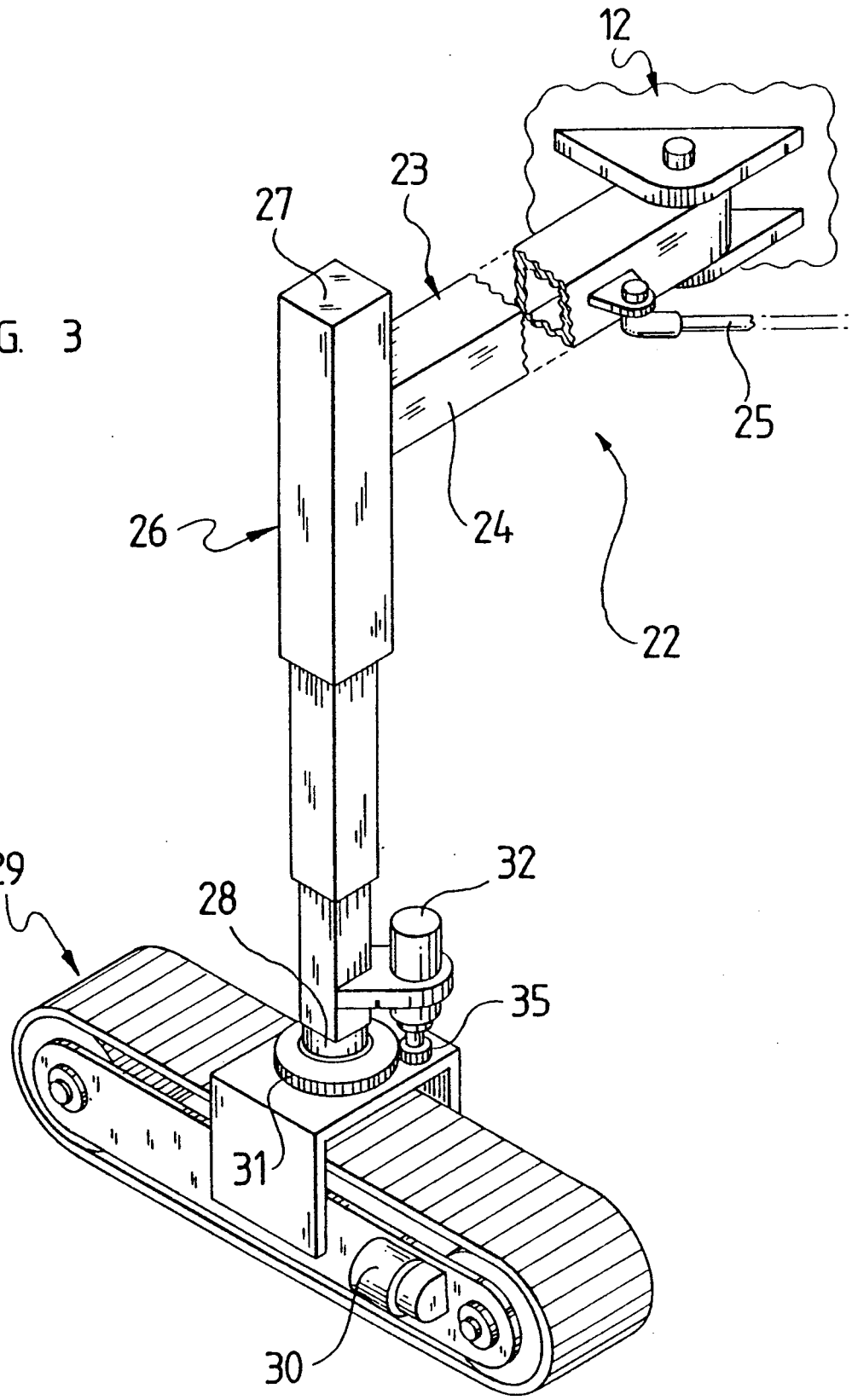
FIG. 3 is a perspective view of a pivoting telescopic leg.

A plurality of extendible support members 22 are pivotally mounted to the box frames 12. As shown in FIG. 3, each support member 22 includes an arm 23 pivotally mounted to the box frame 12 for horizontal movement about a vertical axis. Means for mechanically pivoting said arm 23 includes a fluid operated piston and rod assembly 25 mounted to said box frame 12 and said arm 23. Each arm 23 has a free end 24 to which means for supporting the arm 23 and consequently the frame 11 is mounted. The supporting means includes a fluid operated downwardly extendible telescopic shaft 26 having an upper end 27 mounted to the free end 24 of the arm 23 and a lower end 28.

Mounted to the lower end 28 of each telescopic shaft 26 is a means for propelling the frame 11. The propelling means includes a tracked conveyor 29 rotatively mounted to each shaft 26 for movement around a vertical axis. Each tracked conveyor 29 is propelled by a drive means which includes a motor 30 mounted within each tracked conveyor. Mounted to the tracked conveyor 29 and the lower end 28 of the shaft 26 is a means for mechanically rotating the tracked conveyor 29 about a vertical axis. The pivoting means includes a ring gear 31 affixed to the tracked conveyor 29 and rotatively mounted to the lower end 28 of the telescopic shaft and a steering motor 32 mounted to the lower end 28 of the shaft 26 and operatively connected to the ring gear 31 by means of a pinion gear 35 to selectively rotate the ring gear 31 about a vertical axis.

Figure 4:
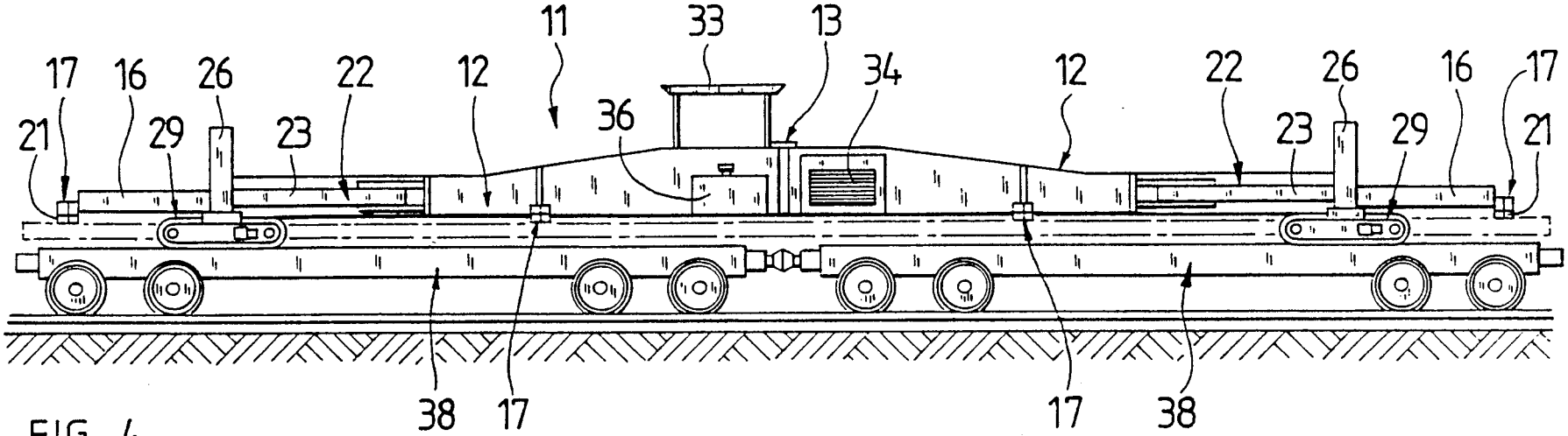
FIG. 4 is a side elevational view of the present invention in transport mode atop a pair of flat cars.

As shown in FIGS. 1, 2 and 4, an operator's booth 33 is mounted to one of the box frames 12 proximate the clevis 13 from which an operator can remotely control the aforementioned functions of the present embodiment of my invention. An engine 34 for powering the fluid operated and electrical functions of the present invention, a fuel storage tank 36 and a hydraulic fluid storage tank 37 are also mounted to the box frames 12.

As shown in FIG. 4, my invention can be loaded on a pair of common flat cars 38 for rapid transport to a work site. When traveling in this manner, the arms 23 are pivoted inward and the telescopic shafts are retracted. The box frames 12 pivot about the clevis 13 as the flat cars 38 are in motion allowing the cars 38 to negotiate turns without subjecting the frame 11 or the cars 38 to unnecessary stress.

FIG. 4 shows the present invention in a transport mode with a section of replacement track 39 secured subjacent to the frame. Even though the present invention is capable of such transport, it is not a requirement for installation of such track. Replacement track can be delivered to the work site on separate flat cars and easily unloaded by the present invention.

Upon reaching the work site, the arms 23 are pivoted away from the frame 11 and the telescopic shaft 26 is downwardly extended. As the tracked conveyors 29 contact the ground, the continued extension of the shaft 26 lifts the frame 11 from the flat cars 38.

Figure 5:
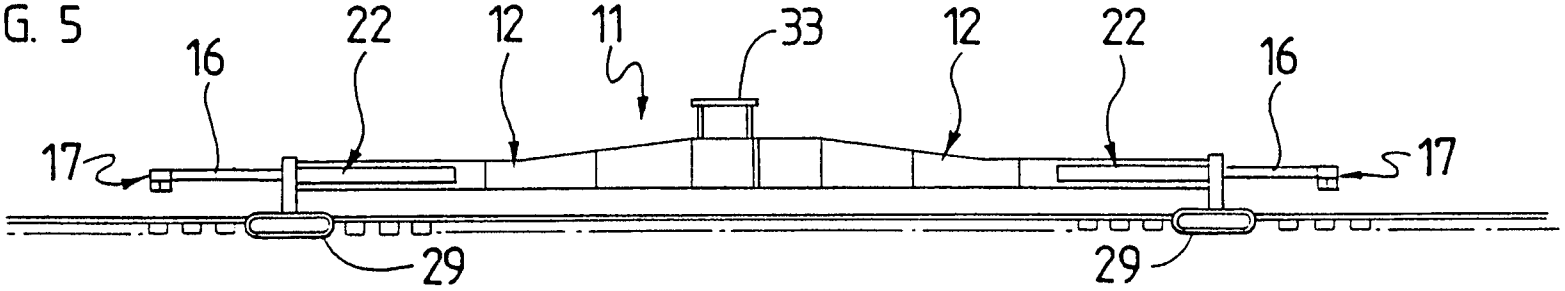
FIG. 5 is a side elevational view of the present invention with legs positioned lateral a subjacent railroad track.
Figure 6:
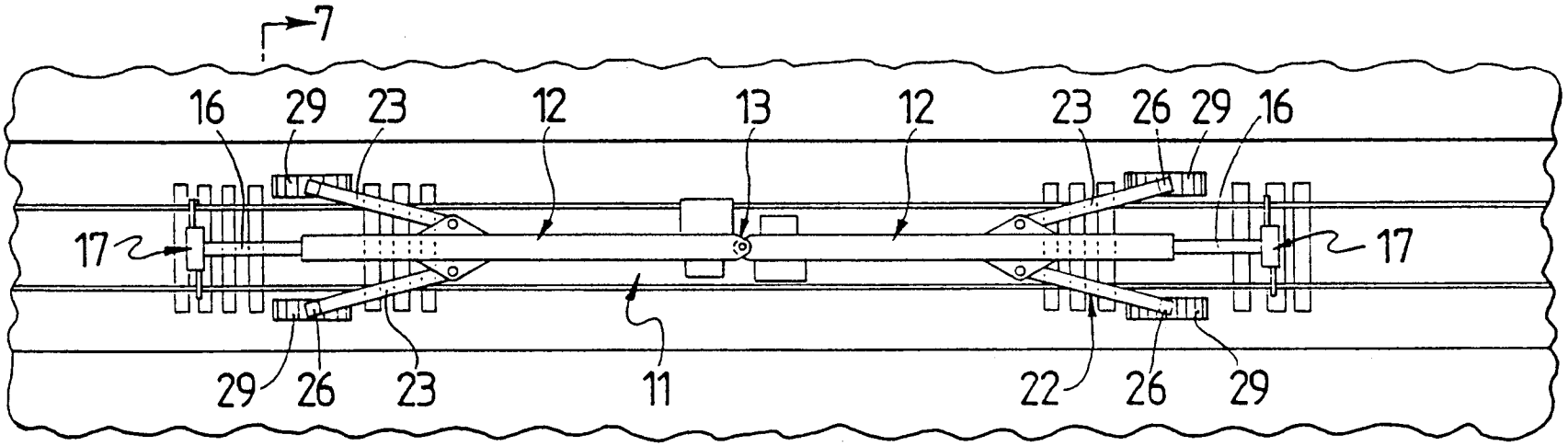
FIG. 6 is a top plan view of the present invention with legs positioned lateral a subjacent railroad track.
Figure 7:
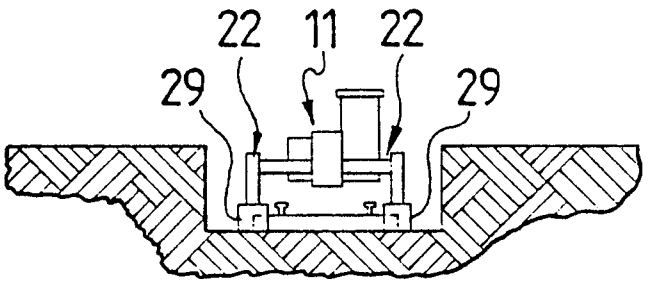
FIG. 7 is a sectional view taken along line 7—7 of FIG. 6.

As shown in FIG. 5, the tracked conveyors 29 rest outside the lateral margins of the in-place track 41. The tracked conveyors 29 can propel the frame 11 and a section of track suspended thereunder in longitudinal or lateral relation to the in-place track 41 being in no way restricted thereby. As shown in FIGS. 6 and 7, the present invention is well adapted for movement within the tight confines typical of a railway as the arms 23 can be pivoted inwardly to position the tracked conveyors 29 in close proximity with the in-place track.

Figure 8:
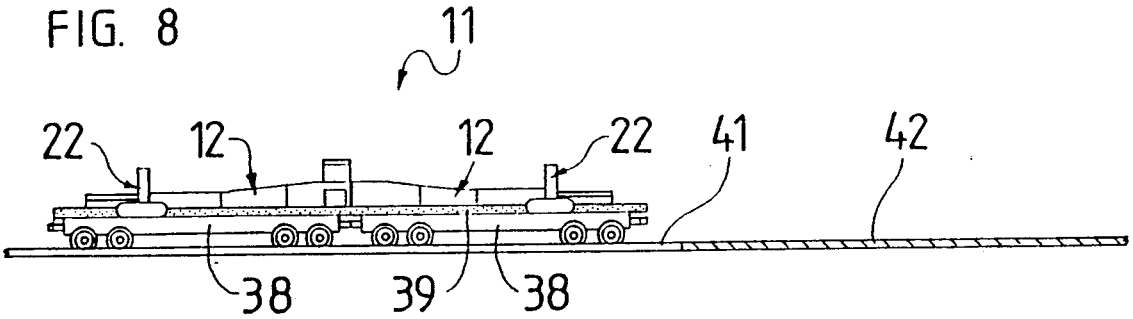
FIG. 8 is a side elevational view of the present invention with a replacement track section suspended thereunder being transported by a pair of flat cars.
Figure 9:
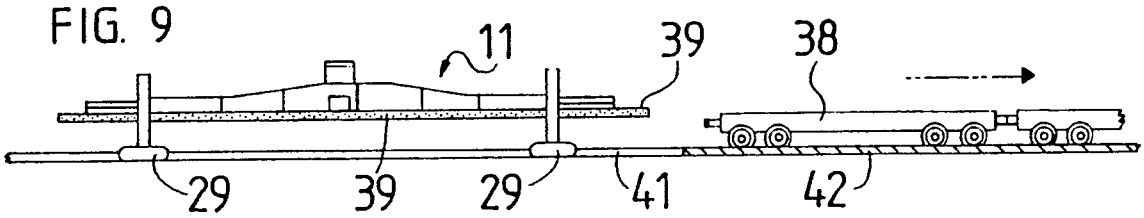
FIG. 9 is a side elevational view of the present invention with legs extended and a pair of flat cars removed from thereunder.
Figure 10:
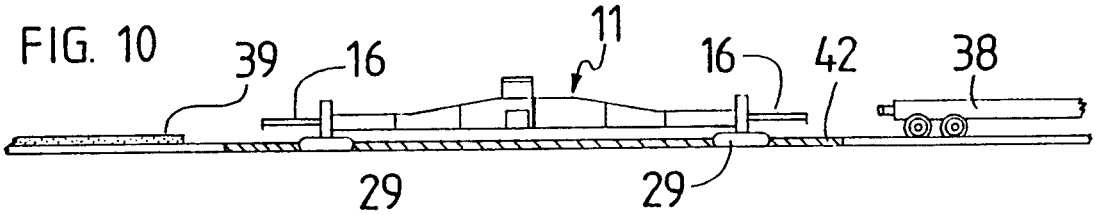
FIG. 10 is a side elevational view of the present invention with legs retracted prior to engagement with a section of track to be removed.

Though the versatility of the present invention could facilitate an unlimited variety of movement and consequently several methods of unloading, removing, and replacing preassembled sections of track, a preferred method is shown in FIGS. 8–13. FIG. 8 shows the present invention delivered on the flat cars 38 with a section of replacement track 39 secured under the frame 11. As shown in FIG. 9, the arms 23 are pivoted outwardly, the telescopic shafts 26 are extended and the flat cars 38 are moved from beneath the frame in the direction indicated by the arrow. The replacement track 39 is lowered to rest on a section of in-place track 41 by retracting the telescoping shafts 26 and subsequently, releasing the rail clamps 21. As shown in FIG.

Figure 11:
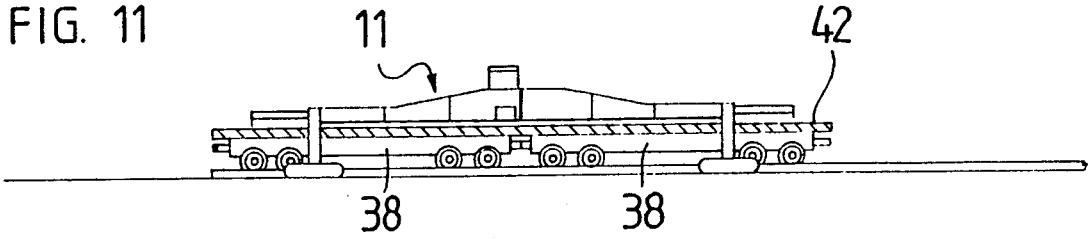
FIG. 11 is a side elevational view of the present invention, with legs extended, loading a removed section of track onto a pair of flat cars.
Figure 12:
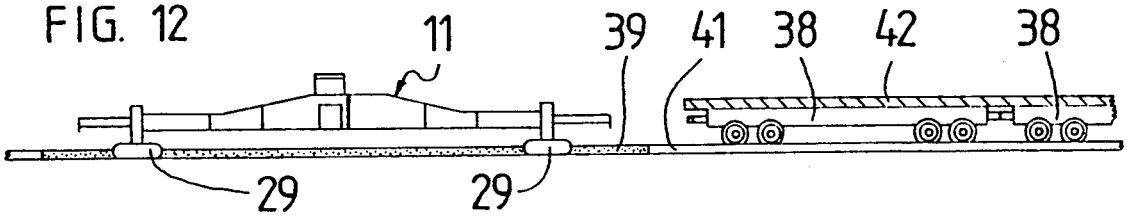
FIG. 12 is a side elevational view of the present invention after replacing a section of replacement track.
Figure 13:
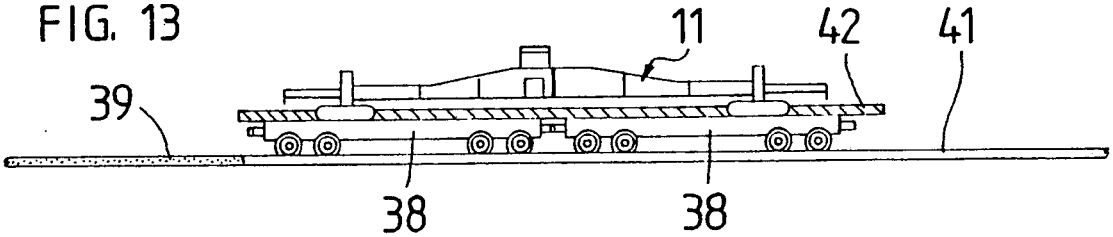
FIG. 13 is a side elevational view of the present invention with a section of removed track suspended thereunder, in transport mode atop a pair of flat cars.

10, the present invention is propelled on the tracked conveyors 29 to a position above a section of unwanted track 42. The telescopic shafts 26 are again retracted and the rail clamps 21 are connected to the unwanted track section 42. As shown in FIG. 11, the telescopic shafts 26 are extended thereby lifting the frame 11 and the unwanted track 42 suspended thereunder. The tracked conveyors 29 convey the frame 11 and unwanted track section 42 above the flat cars 38 whereupon the unwanted track section 42 is subsequently lowered and released onto the flat car 38. As shown in FIG. 12, the present invention places the replacement track section 39 in the space previously occupied by the unwanted track section 42. The tracked conveyors are especially helpful at this stage by laterally adjusting the replacement track section to match the adjacent ends of the in-place track sections 41. As shown in FIG. 13, the present invention is loaded on the flat cars 38 for transport to a new work site.

FIGS. 8–13 show the present invention in operation with one set of flat cars 38 and one section of replacement track 39. However, a great advantage of the present invention is its ability to straddle the width and height of a flat car 38 and thereby traverse the length of an unlimited number of such flat cars 38 to reciprocally retrieve and replace multiple sections of unwanted track 42 with multiple sections of replacement track 39 without disconnecting the aforementioned flat cars 38. From the foregoing, it should be clear that the present invention represents a substantial improvement over the prior art.

While I have shown my invention in one form, it will be obvious to those skilled in the art that it is not so limited but is susceptible of various changes and modifications without departing from the spirit thereof.

What I claim is:

1. A points and crossing changer for removing railroad track assemblies of variable shapes and sizes comprising:

(a) an elongated frame having at least two elongated box frames joined at adjacent ends by at least one clevis and one pin for pivotal movement about a vertical axis;

(b) a pair of sliders, each slidably mounted within one of said elongated box frames for extension and retraction therefrom along the longitudinal axis thereof;

(c) a plurality of extendible support members pivotally mounted to said frame for movement about a vertical axis;

(d) means mounted beneath said support members for propelling said frame ia n unlimited variety of horizontal directions; and (e) means mounted to said frame for selectively engaging a length of said track subjacent said frame for concomitant movement with said frame.

2. A points and crossing changer for removing railroad track assemblies of variable shapes and sizes comprising:

(a) an elongated frame having at least two elongated box frames joined at adjacent ends by at least one clevis and one pin for pivotal movement about a vertical axis and a pair of sliders each slidably mounted within one of said elongated box frames for extension and retraction therefrom along the longitudinal axis thereof;

(b) a plurality of extendible support members pivotally mounted to said frame for movement about the vertical axis;

(c) means mounted beneath said support members for propelling said frame in an unlimited variety of horizontal directions; and (d) means mounted to said frame for selectively engaging a length of said track subjacent said frame for concomitant movement with said frame, wherein said engaging means includes a plurality of adjustable clamp assemblies mounted in spaced relation to said elongated box frames and extendible ends of said sliders, wherein each said clamp assembly has a central casing mounted to said frame and laterally extending in both directions therefrom, a pair of clamp beams slidably mounted within said central casing for opposing lateral extension and retraction therefrom, and a pair of rail clamps, each mounted to and suspended beneath an extendible end of one of said clamp beams for selectively engaging and releasing portions of said railroad track.

3. A points and crossing changer as described in claim 2 wherein each support member comprises:

(a) an arm pivotally mounted to said frame for horizontal movement about a vertical axis and having a free end;

(b) means connected to each of said free ends of said arms for lifting said frame; and (c) a plurality of fluid operated piston and rod assemblies mounted to said frame and said arms for selectively pivoting said arms about said vertical axis.

4. A points and crossing changer as described in claim 3 wherein said lifting means comprises a plurality of fluid operated downwardly extendible telescopic shafts each mounted at an upper end to one of said free ends of said plurality of arms.

5. A points and crossing changer as described in claim 4 wherein said propelling means comprises:

(a) a plurality of tracked conveyors, each rotatively mounted to a lowermost extension of one of said telescopic shafts for movement about a vertical axis; wherein each said tracked conveyor is individually driven by a drive means mounted thereon; and (b) means connected to said lowermost extension of said telescopic shaft and said tracked conveyor for rotating said tracked conveyor.

6. Apparatus for removing and replacing selected portions of railroad track, comprising:

(a) an elongated frame;

(b) a plurality of arms pivotally mounted to said frame for horizontal movement about a vertical axis;

(c) means mounted to each said arm for lifting said frame; and (d) a plurality of tracked conveyors each mounted to and supporting one of said lifting means for propelling said frame in an unlimited variety of horizontal directions such that each of said plurality of arms is pivotally movable about a vertical axis while said lifting means connected thereto supports said arms and said frame.

7. Apparatus as described in claim 6 wherein said elongated frame comprises two elongated box frames, joined at adjacent ends by a clevis and a pin for pivotal movement about a vertical axis.

8. Apparatus for removing and replacing selected portions of railroad track, comprising:

(a) an elongated frame, including two elongated sliders, each longitudinally and slidably mounted within an end of said frame for longitudinal extension and retraction therefrom;

(b) a plurality of arms pivotally mounted to said frame for longitudinal movement about a vertical axis;

(c) means mounted to each said arm for lifting said frame;

(d) a plurality of tracked conveyors each mounted to and supporting one of said lifting means for propelling said frame in an unlimited variety of horizontal directions such that each of said plurality of arms is pivotally movable about a vertical axis while said lifting means connected thereto supports said arms and said frame.

9. Apparatus for removing and replacing selected portions of railroad track, comprising:

(a) an elongated frame;

(b) a plurality of arms pivotally mounted to said frame for horizontal movement about a vertical axis;

(c) means mounted to each said arm for lifting said frame;

(d) means mounted to and supporting said lifting means for propelling said frame in an unlimited variety of horizontal directions;

(e) a plurality of clamps mounted to said frame for engaging said track; and (f) means mounted intermediate each said clamp and said frame for laterally extending and retracting said clamps relative said frame.

10. Apparatus as described in claim 9 wherein said lifting means comprises a plurality of fluid operated telescopic shafts each mounted at an upper end to one said arm and having a lower end.

11. Apparatus as described in claim 10 wherein said propelling means comprises a plurality of tracked conveyors, each rotatively mounted to said lower end of one of said telescopic shaft for movement about a vertical axis, and having means connected thereon and to said lower end for selectively rotating said tracked conveyor.

12. Apparatus as described in claim 11 wherein said propelling means comprises a plurality of motors, each operatively connected to one of said plurality of tracked conveyors for driving said tracked conveyors, wherein said motors can be remotely operated individually and in unison.

13. Apparatus as described in claim 11 wherein said pivoting means for each tracked conveyor comprises:

(a) a ring gear affixed to each tracked conveyor and rotatively mounted to said lower end of said telescopic shaft; and (b) a steering motor mounted to said telescoping shaft and having a pinion gear operatively connected to said ring gear.

14. Apparatus as described in claim 9 comprising means connected to said frame and said arms for selectively pivoting said arms about said vertical axis.

15. A points and crossing changer for removing railroad track assemblies of variable shapes and sizes comprising:

(a) an elongated frame;

(b) a central casing mounted to said frame and laterally extending in both directions therefrom;

(c) a pair of clamp beams slidably mounted within said central casing for opposing lateral extension and retraction therefrom; and (d) a pair of rail clamps, each mounted to and suspended beneath an extendible end of one of said clamp beams for selectively engaging and releasing portions of said railroad track.

* * * * *